United States Patent [19]

Ricchio

[11] Patent Number: 4,713,853

[45] Date of Patent: Dec. 22, 1987

[54] APPARATUS FOR IMPROVED WATER THERAPY

[76] Inventor: Dominic A. Ricchio, 6021 56th Ave., Kenosha, Wis. 53142

[21] Appl. No.: 898,149

[22] Filed: Aug. 19, 1986

Related U.S. Application Data

[60] Division of Ser. No. 447,763, Dec. 8, 1982, which is a continuation-in-part of Ser. No. 371,456, Apr. 23, 1982.

[51] Int. Cl.[4] ..... A47C 27/08

[52] U.S. Cl. ..... 5/451; 5/453

[58] Field of Search ..... 5/422, 451, 453, 455, 5/456; 128/24.1, 33, 39, 40, 64, 66

[56] References Cited

U.S. PATENT DOCUMENTS

| | | | |
|---|---|---|---|
| 3,420,276 | 1/1919 | Berry, Sr. | 128/24.1 |
| 4,066,072 | 1/1978 | Cummins | 5/422 |
| 4,077,074 | 3/1978 | Fogel | 5/451 |
| 4,112,943 | 9/1978 | Adams | 128/24.1 |
| 4,120,062 | 10/1978 | Anderson | 5/453 |
| 4,607,405 | 8/1986 | Ellis et al. | 5/453 |
| 4,635,619 | 1/1987 | Diamond | 128/39 |

FOREIGN PATENT DOCUMENTS

| | | | |
|---|---|---|---|
| 2115190 | 10/1972 | Fed. Rep. of Germany | 5/451 |
| 2601506 | 7/1977 | Fed. Rep. of Germany | 128/64 |

*Primary Examiner*—Alexander Grosz
*Assistant Examiner*—Michael F. Trettel

[57] ABSTRACT

An apparatus and method of water therapy in which a person is buoyantly supported in a prone position on a top membrane of a waterbed mattress containing heated water. A water pump recirculates the water, which is drawn out of the mattress through outlets and associated piping and which is then reintroduced through inlets and associated piping as an array of water jets. Air is introduced by a valve in the water piping on the return side of the pump or by means of a separate air pump connected to air inlets leading into the mattress. Also disclosed are a distributor fitting for insertion into the mattress to mix air and water and a base and frame assembly for concealing the plumbing and air recirculation piping.

11 Claims, 11 Drawing Figures

FIG. 1.
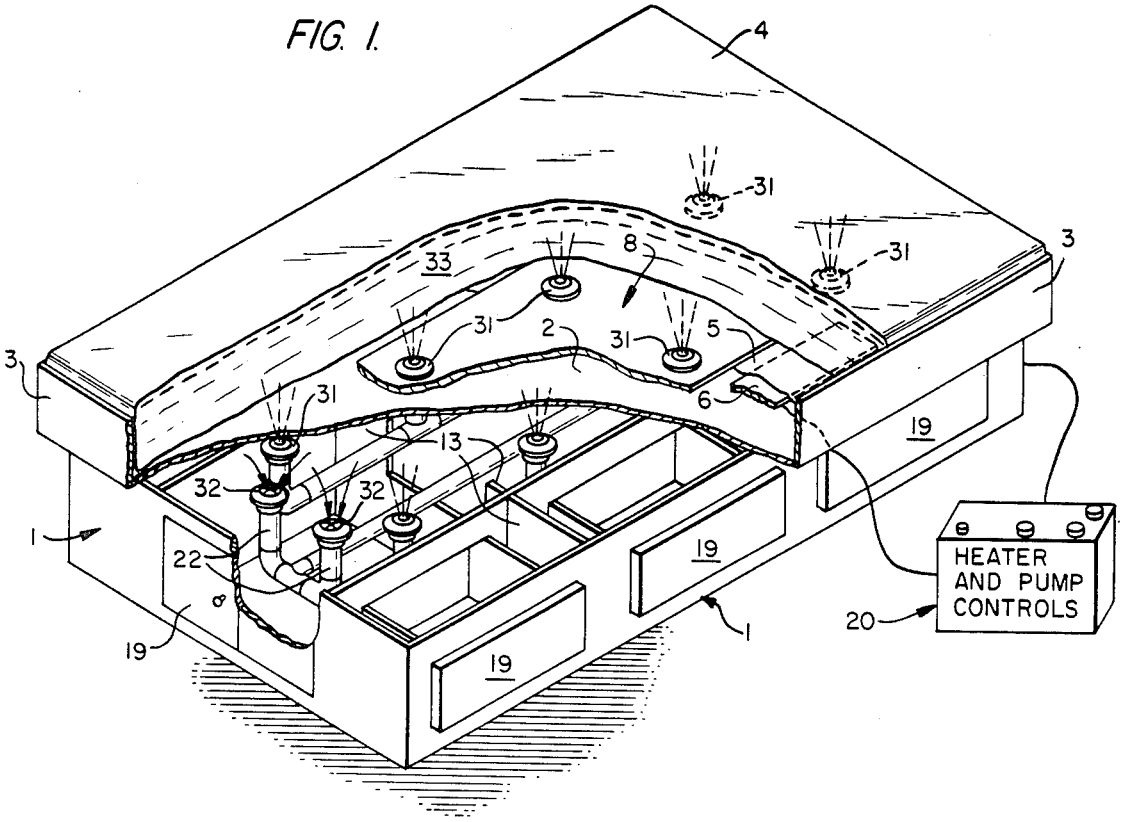
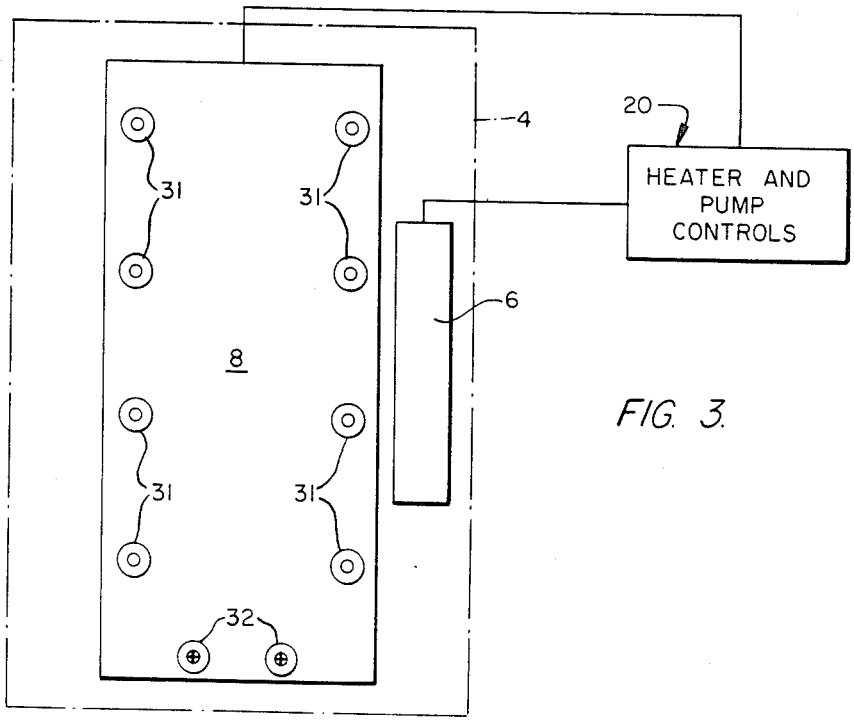
FIG. 3.

APPARATUS FOR IMPROVED WATER THERAPY

CROSS-REFERENCE TO RELATED PATENT APPLICATION

This is a division of my copending application, Ser. No. 447,763, filed Dec. 8, 1982, which is a continuation-in-part of my copending patent application, Ser. No. 371,456, filed Apr. 23, 1982. To the extent the disclosure of that application is not repeated herein, it is hereby incorporated by reference.

BACKGROUND OF THE INVENTION

1. Field of the Invention

The invention relates to waterbeds of the type having a water-containing mattress for buoyantly supporting a person in a prone position.

2. Description of the Prior Art

Conventional waterbeds have been used in treating orthopedic and burn patients, stroke victims, the elderly and persons confined to bed for long periods of time. Such beds are useful in preventing bed sores. While waterbeds have been used for the treatments mentioned above, the treatment of muscular and circulatory ailments has been accomplished with whirlpool or circulating baths. Some of these require that the patient be lowered into the bath water in a chair carried by a hoist, which allows the torso of an infirmed patient to be safely immersed while providing a means for firmly supporting the patient and lifting the patient out of the water, when necessary.

Several prior devices have used relatively small water-filled pads for treating localized areas of the body. In such arrangements the person does not receive the benefits of buoyant support, coverage of the body is incomplete, the water piping apparently carries a small volume at a relatively high pressure and there is considerably more mechanical equipment required for obtaining the relatively isolated effects on the body torso.

There is also known in the wider field of water massage a wide variety of baths. Baths are without a doubt beneficial to mankind, but for use in therapy there is a disadvantageous effect on the skin tissue after a certain amount of time. Another disadvantage is that baths require an amount of pre-bath and post-bath activity, such as drawing the water, undressing, dressing and so forth. At health club facilities where bath water is treated with chemicals it must nevertheless be changed and retreated with such chemicals frequently.

SUMMARY OF THE INVENTION

The invention relates to an apparatus and method for water therapy in which a person is buoyantly supported in a reclining position on a top membrane of an enclosure containing heated water. The water is drawn out of the enclosure, and pressure is imparted to the water, which is then reintroduced in an array of water jets directed into the interior of the enclosure and upwardly against the underside of the membrane. The action of the water jets generates ripples across the underside of the membrane to provide a heated water massage and the beneficial effects resulting therefrom.

The invention more particularly relates to a waterbed apparatus in which a membraneous envelope of water-impervious material is supported by a base and frame assembly with a deck that extends along the bottom of the envelope and with sidewalls rising upwardly from the deck around the perimeter of the envelope. A retainer member of water-impervious material is disposed beneath the bottom of the envelope and in the middle of the deck. An array of water inlets and at least one water outlet are anchored in the retainer, the array of inlets being spaced from the outlet, and the inlets and outlets all opening into the envelope and sealingly clamping the bottom membrane of the envelope to the retainer. The inlets are operable for conveying streams of pressurized water into the envelope and the outlets are operable for conveying water out of the envelope for recirculation. A water pump is positioned below the deck and is connected to receive the water for recirculation from the outlet. The pump imparts pressure to the water and is connected to the array of inlets for introducing streams of pressurized heated water into the envelope and upwardly against the underside of the top membrane.

One object of the invention is to apply massaging streams of water and to provide the pleasurable and therapeutic effects thereof on a human body without the necessity of submerging any part of the body. The near immersion of patients with the apparatus currently used for physical therapy at medical facilities requires careful supervision which can be reduced with the invention. The invention also provides an apparatus that is usable for rest and relaxation as well as for therapy. The apparatus can be located in a wide variety of places within a medical facility or residence and is not limited to location in a bathroom.

Another object of the invention is to provide the circulating streams of water in an apparatus in which a body of the individual is buoyantly supported. Buoyant support alleviates painful pressure points.

Another object of the invention is to provide an array of heated pressurized streams of water at preselected locations corresponding to areas of the body where massaging effects are most effectively applied such as the neck, shoulders, back, arms and legs.

Another object of the invention is to provide a plurality of therapy treatments by aspirating an array of water jets, or by introducing air into a water mattress to generate an aspirated layer of water that impinges upon the underside of the membrane. Aspirated water jets provide an alternative mode of operation to the use of unaspirated water jets and may be preferred for pleasure or therapy by certain individuals.

A more specific object of the invention is to support the plumbing necessary to produce water jets while providing a sealing connection thereof to a waterbed mattress. This is accomplished by means of a stiff support member of a water-impervious material.

Still another object of the invention is to provide an aesthetic appearance for a waterbed which is accomplished by hiding the mechanical components within the base and frame assembly. The base and frame assembly may be formed with pockets at either the head or foot end in which fittings can be sealingly connected to the top membrane of the mattress for withdrawal of air.

There are basic advantages of the invention over whirlpool and circulating baths in conserving water, and reducing the cost of operation by lowering requirements for chemicals to treat the water.

Other objects and advantages of the invention will appear in the following description, wherein reference is made to the accompanying drawings that form a part hereof, and in which there is shown by way of illustration several preferred embodiments of the invention. These embodiments, however, do not necessarily represent the full scope of the invention, but are merely illustrative, and therefore references are made to the claims at the end of the description for determining the scope of the invention.

BRIEF DESCRIPTION OF THE DRAWINGS

FIG. 1 is a perspective view of a first embodiment of a waterbed of the invention with parts broken away for a better view;

FIG. 3 is a schematic plan view of the distribution of inlets, outlets and a heater that are seen in FIG. 1;

DETAILED DESCRIPTION OF THE PREFERRED EMBODIMENTS

A first preferred embodiment of a waterbed that incorporates the present invention is illustrated in FIGS. 1-6. Referring to FIG. 1, the waterbed has a rectangular base or pedestal 1 with a generally open interior that is traversed by vertical cross members 13 that extend longitudinally and transversely between its outer walls to provide additional support. These cross members 13 also effect a partitioning of the interior into smaller compartments.

Drawers 19, a typical item in waterbeds, are provided to slide in and out of the compartments through the sides of the pedestal 1. Access doors 39 are provided at the foot end of the pedestal 1 for access to the plumbing to be described more particularly below.

Figure 4:
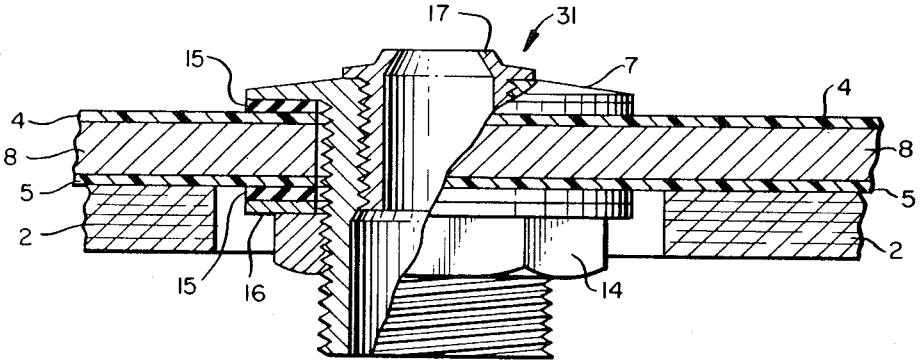
FIG. 4 is a detail section view of one of the inlet assemblies seen in FIGS. 1 and 2.
Figure 5:
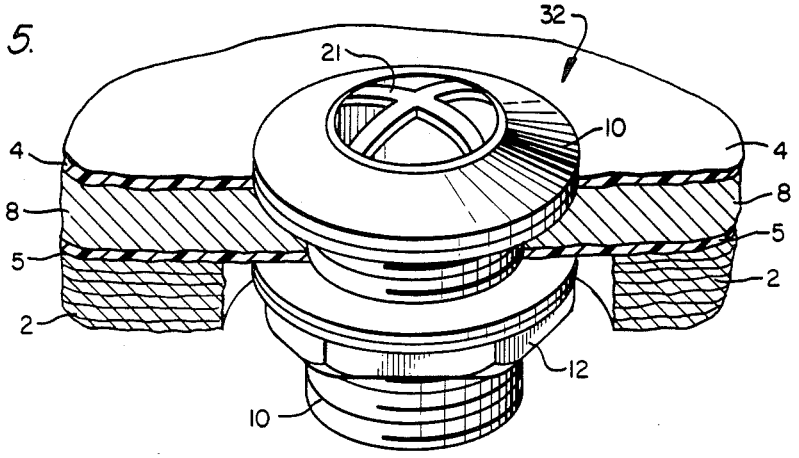
FIG. 5 is a fragmentary, perspective view of one of the outlet assemblies seen in FIGS. 1 and 2.

Also seen in FIG. 1 is a wood frame comprising a generally horizontally extending deck 2 that rests on top of the pedestal 1. The frame also has four upstanding sidewalls 3 rising upwardly from the deck 2 and surrounding the perimeter of a waterbed mattress 4 supported by the deck 2 and pedestal 1. The mattress 4 is made of a flexible vinyl membrane that is impervious to water and is sealed to form an envelope with top, bottom and side portions to contain a volume of water 33. For convenience of the description, these will each be referred to as a membrane with its being understood that they may in fact be portions of a larger membrane. The mattress 4 is partially filled through an uncapped filler assembly (not shown) with about one hundred and sixty gallons of water 33, which when contained in the mattress stands about nine inches deep. Although mattresses of various sizes and capacities are usable with the invention, it is preferred that mattresses of the invention contain a layer of water about nine to ten inches deep. The mattress 4 substantially fills the length and width of the frame cavity, with the top of the mattress 4 being about even with the top of the sidewalls 3, and the sides of mattress 4 being contained against outward expansion by the sidewalls 3. A vinyl safety liner 5 seen in FIGS. 4 and 5 is positioned under the mattress 4 and is folded upwardly along its sides to protect the wood frame and the area surrounding the waterbed from any leakage. The elements mentioned so far, except the access doors 39, are typically found in conventional waterbeds. An item of optional equipment used with most waterbeds is the elongated heating pad 6 illustrated in FIGS. 1 and 3, which is positioned on the deck 2 underneath the safety liner 5 and is used to heat the water 33 above the average room temperature. Also included in the mattress 4 (through not shown in FIG. 1) are several baffles which damp and reduce waves within the mattress 4.

Conventional waterbeds have been used in treating orthopedic and burn patients, stroke victims, the elderly and persons confined to bed for long periods of time. Such beds are useful in preventing bed sores. While waterbeds have been used for treatments mentioned above, the treatment of muscular and circulatory ailments has been accomplished with whirlpool and other circulating baths. Some of these require that the patient be lowered into the bath water in a chair carried by a hoist. What I have conceived is that both of these treatments can be better performed by a waterbed in which heated water is circulated and in which jets of heated pressurized water are directed against the underside of a membrane on which a reclining body is supported in a fleating manner. Preferably the water is heated in a range between 80 and 102 degrees F. when used for typical therapy sessions of thirty minutes. I have further conceived an arrangement of plumbing in a waterbed that produces water jets that impinge on the underside of the membrane. In providing this plumbing there is the problem of sealing the waterbed mattress around the area where inlet nozzles would introduce such jet streams into the mattress. Also, due to the large volume of water used in a waterbed mattress, the plumbing, and more importantly, the weight of the water contained in the plumbing, presents a heavy item to be supported.

I have solved the first problem by anchoring an array of inlet assemblies 31 and a plurality of outlet assemblies 32 in a stiff retainer plate 8 as seen in FIGS. 1, 3 and 4. This plate 8 covers an area slightly larger than a human body, is centrally positioned on the deck 2, as seen in FIG. 1, and is positioned between the safety liner 5 and the bottom membrane of the mattress 4 as seen best in FIGS. 4 and 5. The central location allows room for the elongated heating pad 6 to extend along the deck 2 on one side of the retainer plate 8 as seen in FIG. 3, in thermal contact with safety liner 5 and the bottom of the mattress 4 to direct heat to the body of water contained therein. The baffles are also positioned to the sides of the retainer plate 8 to be out of the way of water jets 34. The retainer plate 8 is preferably made of eighteen gauge metal, which will flex slightly, if necessary, to carry the loads imposed on it, but will not be deformed by such loads. The material used for the retainer plate 8 is impervious to water. Other materials including plastics could also be used, provided they have the above-mentioned qualities. A preferred type of metal is stainless steel due to its non-corrosive characteristics in moist environments. The retainer plate 8 should be smooth on its broad surfaces and along its edges so as not to perforate the bottom of the mattress 4 or the safety liner 5.

Figure 2:
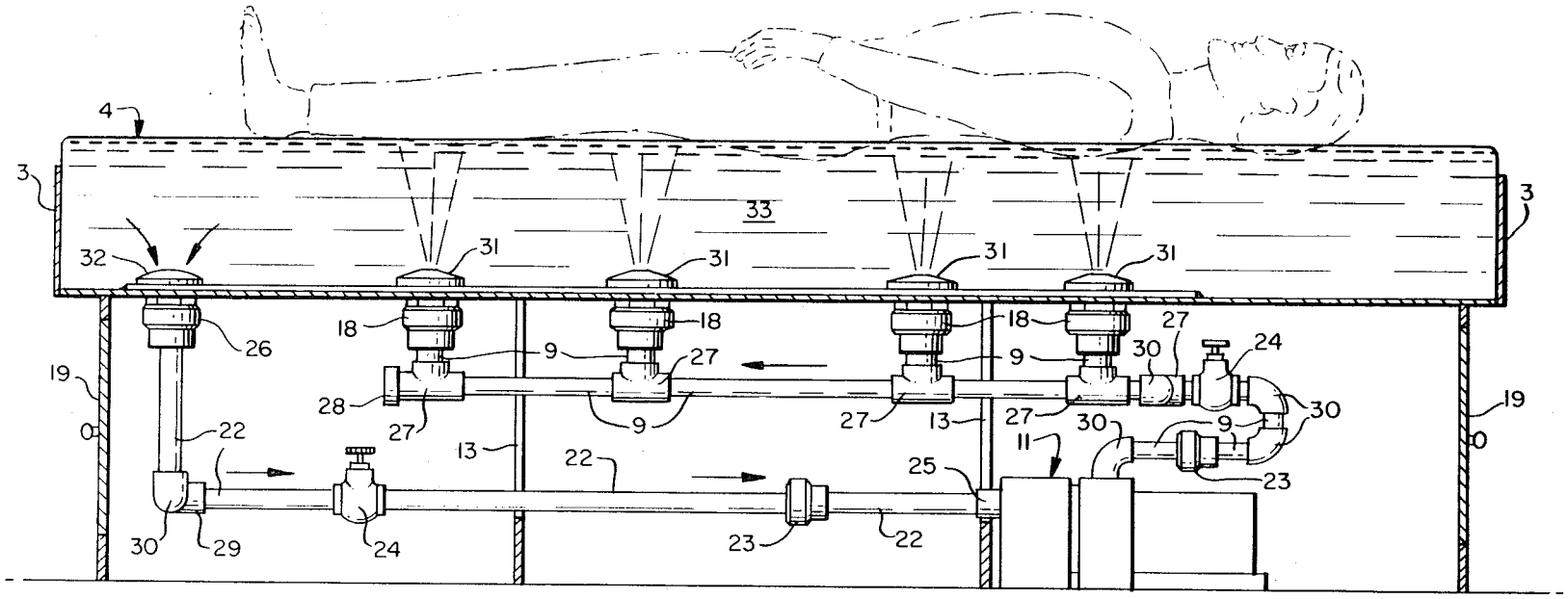
FIG. 2 is a longitudinal section view of the waterbed of FIG. 1 taken in a vertical plane.

Referring to FIG. 3, eight inlet assemblies 31 are arranged in an array so as to direct jets of heated water against various areas along a body positioned on the top membrane of the mattress 4 as seen in FIG. 2. A pair of outlet assemblies 32 are located away from the inlet assemblies 31 and towards the foot end of the mattress 4 so as not to disturb the water jets 34 emanating from the inlet assemblies 31.

One of the inlet assemblies 31 and the manner in which it is anchored in the support plate 8 will now be described with reference to FIG. 4. As seen there, the deck 2 has a relatively large aperture 35 through which the inlet assembly 31 extends. The assembly 31 has a threaded fitting 7 with a flange that can be inserted through an opening in the bottom membrane of the mattress 4. The body of this fitting 7 can then be inserted through an aperture in the retainer plate 8 and an opening of corresponding size in the safety liner 5. A first washer 15 of synthetic, elastomeric material is captured between the underside of the fitting flange and the bottom membrane of the mattress 4. A second such washer 15 is pressed against the underside of the safety liner 5 by a PVC washer 16 and locknut 14 which threadingly engages the body portion of fitting 7 to sealingly clamp onto the combination of the mattress membrane 4, retainer plate 8 and safety liner 5. The weight of the water-filled mattress 4 prevents the retainer plate 8 and the inlet and outlet assemblies 31 and 32 from shifting position and stressing the membrane of the mattress 4. An inlet nozzle member 17 is received in an inner threaded bore within the fitting 7. The parts of the inlet assembly 31, aside from the washers 15, are preferably made of a polyvinyl chloride (PVC) material. Other materials, such as ABS (acrylonitrile-butadiene-styrene) plastic can also be used for these parts.

Referring now to FIG. 5, an outlet assembly 32 for drawing water by suction is anchored to the retainer plate 8 by a fitting 10 and a locknut 12 which clamp a pair of washers 15 of synthetic elastomeric material against the bottom of the mattress 4, the retainer plate 8 and the safety liner 5. Again, the fitting 10 extends through a larger opening 35 in the wooden deck 2. The outlet fitting 10 is provided with a safety grate 21 across its drain opening to prevent portions of the mattress 4 and other large objects from being sucked into the plumbing. The safety grate 21 is also believed to provide for an even draw of water from all directions.

Figure 6:
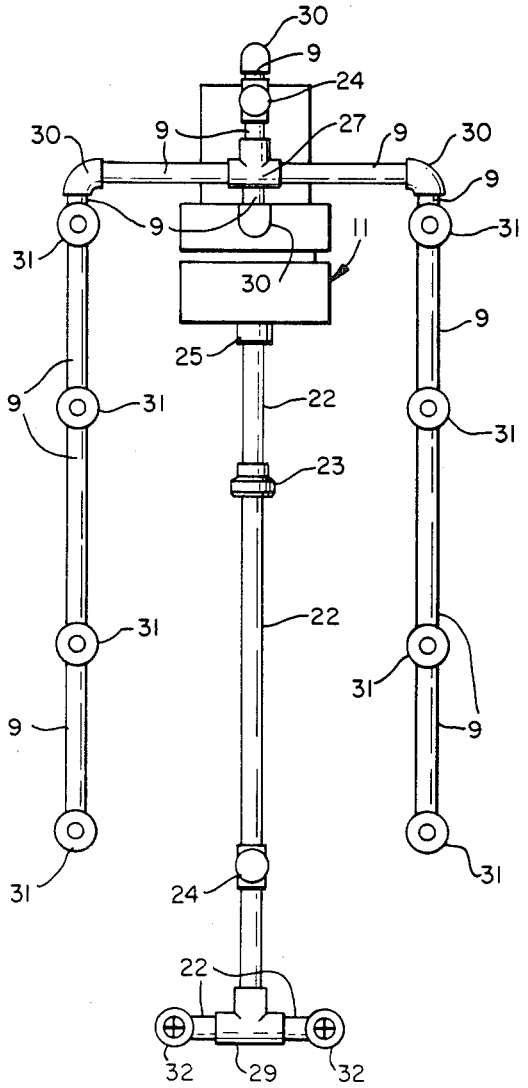
FIG. 6 is a plan view of the plumbing seen in FIG. 2.

Referring now to FIGS. 2 and 6, an arrangement of plumbing passes through openings in the cross members 13 of the pedestal 1. Inlet assemblies 31 are coupled through inlet coupling unions 18 and T-shaped fittings 27 to respective branches of inlet feeder piping 9. The branches are connected to a main trunk of the feeder piping 9 through another T-shaped fitting 27 at one end and are terminated by plugs 28 at an opposite end. A water recirculation pump 11 is situated at floor level within the interior of the pedestal 1. The discharge side of the pump 11 is connected to the main trunk of the inlet piping 9, through a pump disconnect union 23, a series of elbow fittings 30 and a shut-off valve 24 just before the closest T-shaped fitting 27. Like the inlet and outlet assemblies 31 and 32, this piping 9 and its associated fittings 27 and 30 are preferably made of PVC material. The outlet assemblies 32 are connected to the return side of the pump 11 through outlet coupling unions 26, return piping 22, a T-shaped connector 29, a second shut-off valve 24, and a second pump disconnect union 23. The inlet and outlet coupling unions 18 and 26 provide a convenient means of connecting the piping 9 and 22 to the inlet and outlet assemblies 31 and 32, while the pump disconnect unions 23 and 24 provide a convenient means of assembling the waterbed and a means of disconnecting the piping 9 and 22 for servicing the pump 11. Shut-off valves 24 are provided so that the pump 11 can be disconnected without draining the water 33 from the mattress 4. Controls for the pump 11 and heating element 6 are housed in control box 20 and connected to the pump 11 and heating element 6 through conventional electrical connections as seen in FIGS. 1 and 3.

Much has been said and written about the beneficial effects of whirlpool and circulating baths. My apparatus operates differently from these in directing jets of water 34 upwardly and generally parallel to impinge upon the underside of the top membrane of the waterbed mattress 4. This operation allows the waves reflected from the membrane to reinforce or partially cancel each other, and create a rippling effect under a body positioned on the mattress 4. Thus, the apparatus of the invention is believed to exemplify a method of water therapy not heretofore known. This method includes the steps of supporting a body in a reclining position on the top membrane of an envelope containing heated water, introducing an array of jets into the envelope generally upwardly and perpendicular to the top surface of the water to impinge upon the underside of the top membrane and create a multitude of ripples across the membrane, and drawing water from a region near one end of the envelope and recirculating this water to provide a continuous supply of water for the water jets 34.

I have found that the massaging affects of such a waterbed are improved by increasing the number and density of inlet assemblies 31. This however requires a pump of greater capacity and a considerable amount of additional piping and fittings, which adds to the expense of the waterbed. To reduce the expense and complexity of the waterbed, while expanding the range of therapeutic effects, I have provided a second embodiment of my invention in FIGS. 7–9. In this embodiment I have provided two alternative modes of operation to introduce air and thereby aspirate the water being directed against and along the underside of the top membrane of a waterbed mattress 40. This mattress 40 is similar in construction to the mattress 4 in FIGS. 1–6, however it can be seen more clearly in FIG. 8 that there is some slack in the top membrane allowing it to provide loose folds at its ends, which are lifted several inches above the top surface of the water 48.

Figure 8:
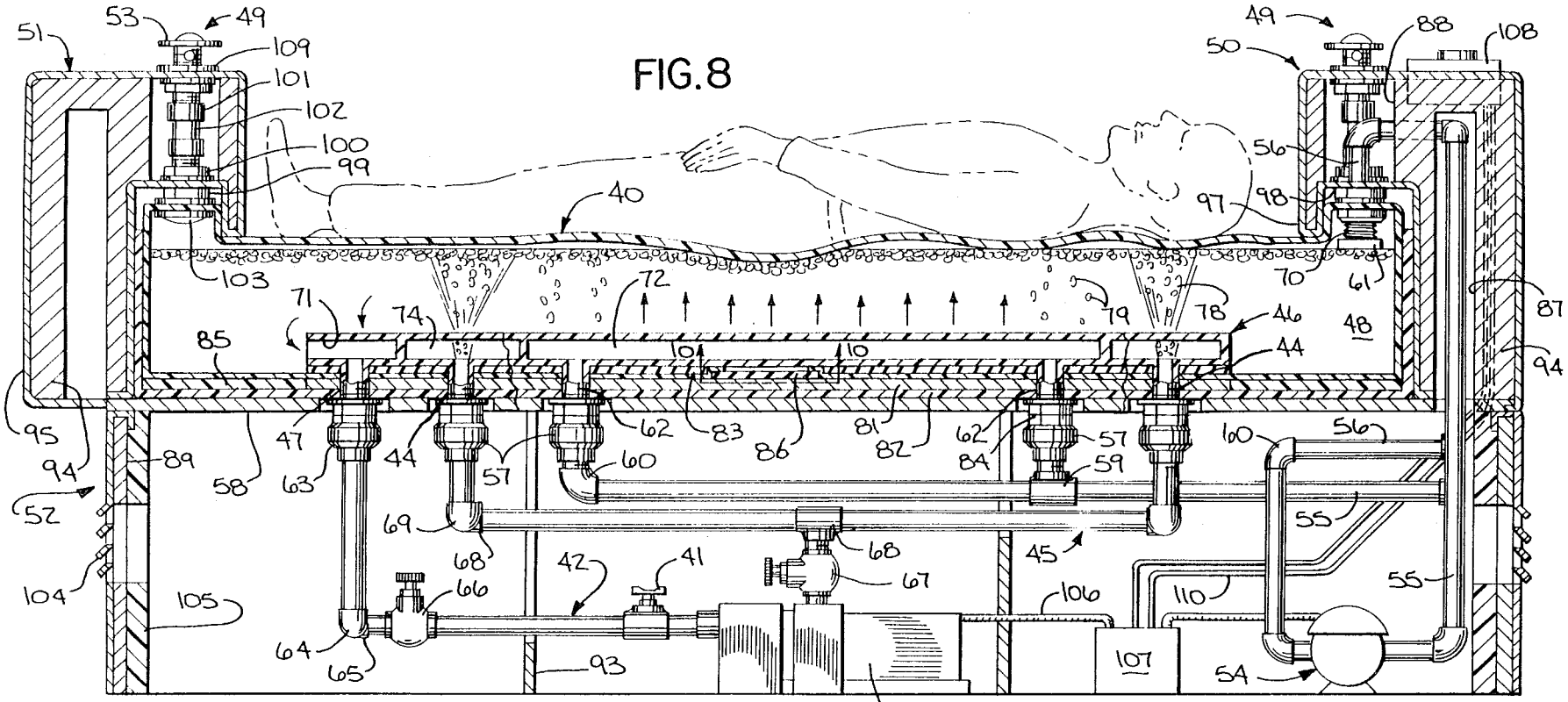
FIG. 8 is a longitudinal section view of the waterbed of FIG. 7 taken in a vertical plane.

In a first mode of operation illustrated in FIG. 8, an air inlet valve 41 is connected in a line of return piping 42 going to a water pump 43, and when the valve 41 is opened, it allows air to be sucked through the pump 43 and mixed with the water conveyed to water inlets 44 through inlet feed piping 45. This produces aerated water jets 78 emanating from the inlets 44 into the mattress 40.

Figure 7:
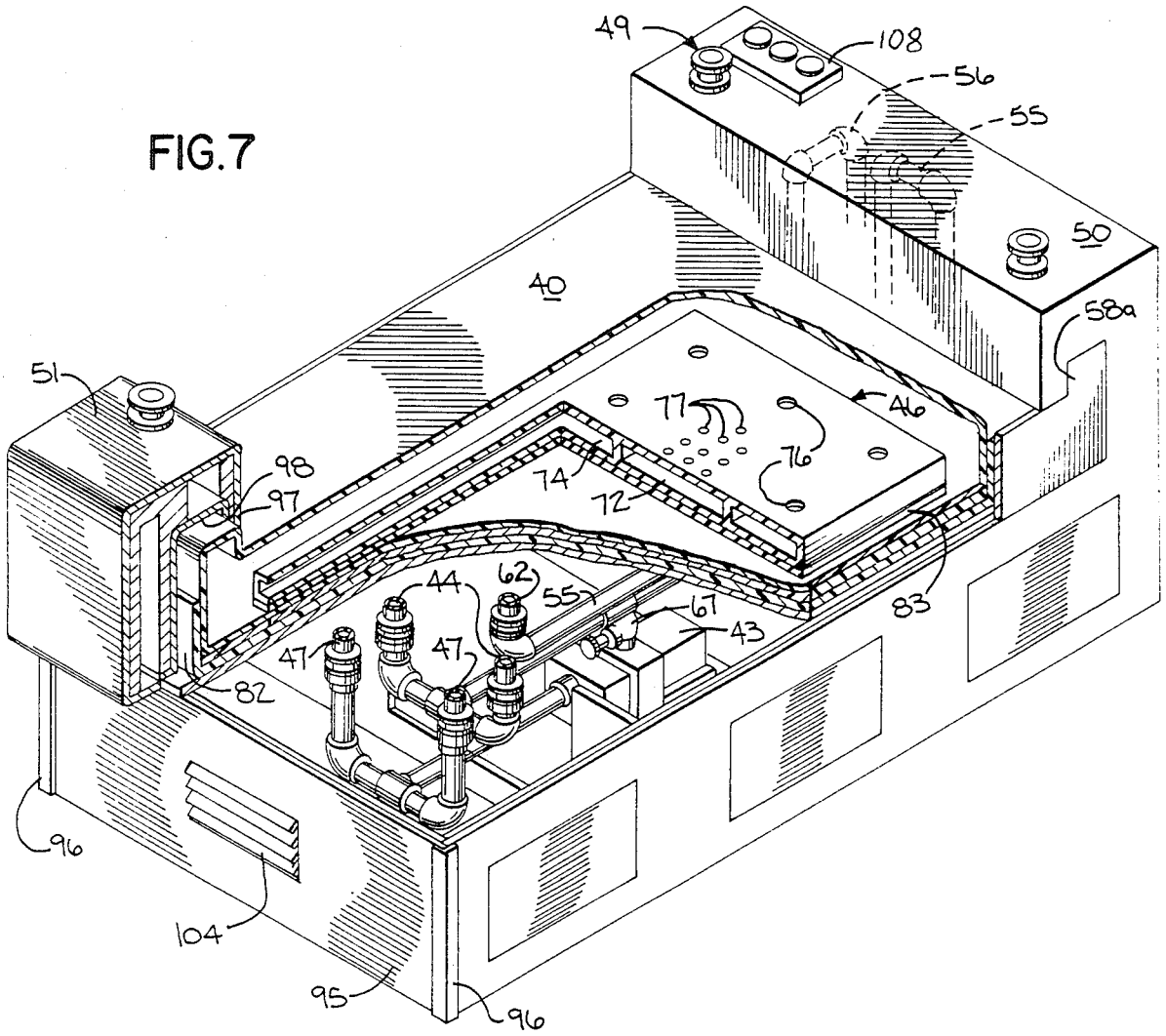
FIG. 7 is a perspective view of a second embodiment of the invention with parts broken away for a better view.

To control the amount of air that collects in the mattress 40 above the layer of water 48, a plurality of air relief valves 49, seen in both FIGS. 7 and 8, are mounted in a head 50 and a foot 51 of a base and frame assembly 52 that rises above the overhangs the respective ends of the mattress 40. By unscrewing the caps 53, seen best in FIG. 8 at the top ends of the air relief valves 49, a balance can be maintained between the air entering and leaving the mattress 40. Also, a desired amount of air can be allowed to accumulate in the mattress 40 prior to balancing the air intake and exhaust. The mattress 40 is also provided with an air pressure safety valve (not shown) so that if the air pressure should reach a certain high pressure limit, the valve will open. With a layer of pressurized air above the water 48 the application of water jets 78 provides a different type of effect that may be preferred by some users to effects obtained with the apparatus of the first embodiment.

In a second mode of air-injected operation, an air pump 54 seen in FIG. 8 is situated at floor level in the interior of the base and frame assembly 52 to supply pressurized air. An air inlet feed line 55 rises vertically upward into a cavity 87 in the head 50 of the base and frame assembly 52. As seen in FIG. 7 the air inlet feed line 55 has an 180-degree bend at its upper extent and travels back down and beneath the deck 58 of the base and frame assembly 52 as seen in FIG. 8. The inlet line 55 then extends laterally through a T-fitting 59 and an elbow fitting 60, respectively, and through unions 57 to a pair of air inlets 62, through which air is fed into the interior of the mattress 40. The rise of the air inlet feed line 55 above the water level keeps water 48 from being fed back into the air pump 54 when that pump is off. Nevertheless, the air pump 54 is preferably of the type in which its motor is sealed against moisture passing through its impeller portion.

Air is evacuated from the mattress in the second mode illustrated in FIG. 8 either through the relief valves 49 or through a suction pipe 56 that is connected through a series of elbow fittings 60 to the suction side of the air pump 54. This pipe 56 extends upwardly from the air pump 54 into the head 50 of the base and frame assembly 52 and through a portion of the vertical cavity 87 in which the air inlet piping 55 is also situated. The air suction pipe 56 then extends outwardly and down through a cavity 88 in a portion of the head 50 overhanging the head end of the mattress 40. A floating air intake unit 61 with upwardly opening apertures is connected through extensible tubing 70 to the suction pipe 56 to draw air off the top of the water 48.

For the second mode of air-injected operation the water pump 43 is connected to four water inlets 44 and two water outlets 47 in a manner illustrated in FIGS. 7 and 8. The inlets 44 and outlets 47 are formed as integral parts of an air and water distributor fitting 46. The inlets 44 and outlets 47 are formed with threads around their outside circumference for connection to the plumbing. The water outlets 47 are connected through unions 63, elbow fittings 64 and T-fittings 65 (partially hidden) and a shut-off valve 66 to the return side of the water pump 43. The discharge outlet on the pump 43 is connected through a shut-off valve 67, T-fittings 68, elbow fittings 69, inlet feed piping 45 and unions 57 to the four water inlets 44. Pump disconnect unions can also be provided but have not been shown in FIG. 8.

To provide aerated streams of water with a minimum amount of plumbing, I have provided the wafer-shaped air and water distributor fitting 46, which is preferably made of an acrylic polymeric material, for inclusion in the interior of the waterbed mattress 40. The rectangular distributor fitting 46 have top and bottom planar sides that are relatively long and wide, as seen best in FIG. 7, to cover an area slightly larger than the body of a six-foot person of average weight. As seen in both FIGS. 7 and 8, this distributor 46 is relatively thin compared to its length and width.

Figure 11:
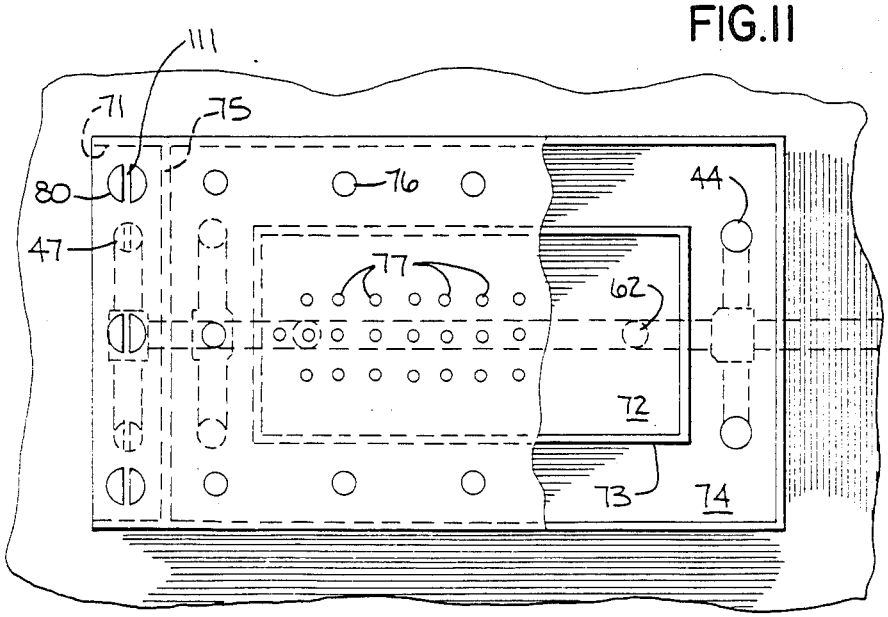
FIG. 11 is a plan view of an air and water distributor seen in the embodiment in FIG. 7.

As illustrated best in FIG. 11 the interior of the distributor fitting 46 has a rectangular, inner chamber 72 that is separated by a rectangular, looped interior divider 73 from an outer chamber 74 that loops around the inner chamber 72 and divider 73. The outer chamber 74 is enclosed by three short exterior sidewalls connecting the top and bottom sides of the distributor fitting 46 and a transverse divider 75 spaced from the interior divider 73 and extending between the sidewalls to separate the outer chamber 74 from a compartment 71 opening towards the foot end. The two air inlets 62 are spaced along the longitudinal axis of the distributor fitting 46 and open into the inner chamber 72. The four water inlets 44 are located to enter near the four corners of the outer chamber 74. Water jet ports 76 are spaced along the length of the top portion of the distributor fitting 46 that encloses the outer chamber 74 so that the four streams of pressurized water entering the outer chamber 74 are divided and dispersed into a greater number of pressurized streams leaving the manifold 46. An array of smaller air stream ports 77 are formed in the top portion of the distributor fitting 46 that encloses the inner chamber 72. These divide and distribute pressurized air from the two large streams entering chamber 72 into many smaller streams 79 of pressurized air leaving the distributor fitting 46 in FIG. 8. As the pressurized streams of water 78 and air 79 leave the distributor fitting 46 and flow towards the top membrane of the mattress 40, they will become mixed to form an aspirated layer of water along the underside of the mattress membrane.

Referring again to FIG. 11, the water outlets 47 are located in the compartment 71 opening towards the foot end of the waterbed so as to draw water out of the mattress 40 without interfering with the air and water jets 78 and 79 being directed towards the top membrane of the mattress 40. The water outlets 47 and two return ports 80 are formed with integral cross members 111 that perform the same function as the safety grates 21 in the first embodiment.

By dividing a few large streams of air and water into many smaller streams, a distributed aspirated layer of water can be provided for a pleasurable and therapeutic effect without unduly increasing the amount of piping to convey the air and water from the pumps 43 and 54 under the deck 58. The number of water inlets 44 can actually be reduced to two, the number of water outlets 47 can be reduced to one, and the number of air inlets 62 can be reduced to one, however, I prefer to provide the numbers shown in FIG. 11 for greater volume and stronger massaging effects over the full area of the user. For the greatest range of pleasurable and therapeutic effects, the distributor fitting 46 can be provided in the same embodiment as the air inlet valve 41 as seen in FIG. 8.

The integral air and water inlets and outlets 44, 47 and 62 in distributor fitting 46 are connected in slightly different manner to the plumbing, the deck 58 and retainer plate 81 than in the first embodiment. As seen in FIG. 8 the bottom membrane of the mattress 40, the retainer plate 81, a safety liner 82 and a large, rectangular, apertured gasket 83 are clamped between the bottom of the distributor 46 and locknuts 84. The retainer plate 81 and safety liner 82 are similar to those in the first embodiment, but the retainer plate 81 is centered in layer of foam material 85 to provide a flat surface underneath the bottom membrane of the mattress 40. The thickness of the sectioned layers in FIGS. 7, 8 and 9 has been somewhat exaggerated as an aid in disclosing the details of carrying out the invention.

Figure 10:
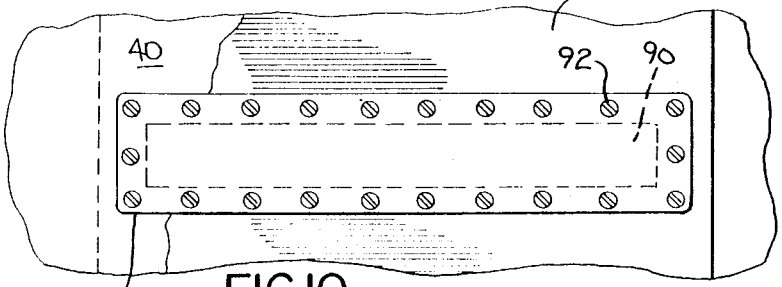
FIG. 10 is a plan view of the sealing cover of FIGS. 8 and 9 and its surrounding area.
Figure 9:
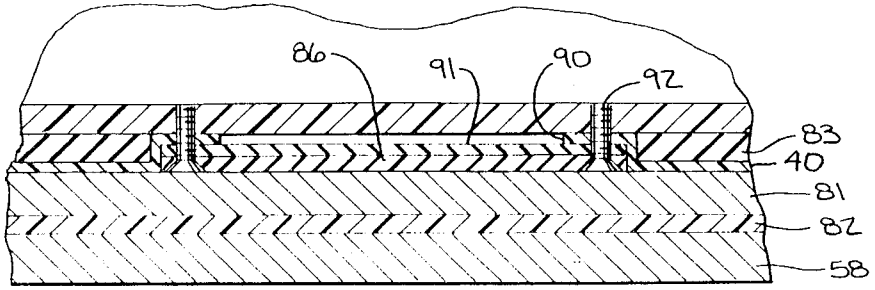
FIG. 9 is a detail section view showing the manner of attaching a sealing cover shown in FIG. 8.

To insert the distributor fitting 46 into a sealed mattress of the type offered by mattress manufacturers, I have devised a seal cover 86 seen in FIGS. 9 and 10 for sealing an opening 90 in the bottom membrane of the mattress 40. As seen in FIG. 10 the opening 90 is slightly shorter than the width of the distributor fitting 46. This opening 90 also has some width transverse to its longer dimension, so that it can be stretched to allow insertion of the distributor fitting 46. This cover 86 is made of the same material as the distributor fitting 46. A gasket 91 of less thickness than the large gasket 83 is seen in FIG. 9 and is used to sealingly press the portions of the mattress 40 against the distributor 46, the larger gasket 83 compensating for the added thickness of the cover 86. The cover 86 is fastened with countersunk screws 92 that are inserted with sealant through the cover 86 and into corresponding holes in the bottom of the distributor fitting 46. A simpler method, but one requiring additional equipment would be sealing the seams of an unsealed mattress membrane after the distributor fitting 46 is inserted. In both methods of inserting the distributor fitting 46, the holes for inlets and outlets 44, 47 and 62 are cut in the bottom of the mattress 40 prior to insertion of the distributor fitting 46.

Other aspects of the invention are provided by the base and frame assembly 52 seen in FIGS. 7 and 8. The assembly 52 is formed by a wooden core that includes a pedestal 89 with cross members 93, the deck 58, and risers 94 within the head 50 and foot 51 of the assembly 52 that extend upwardly above the ends of the mattress 40 and over the top membrane. These risers 94 are formed with cavities 87 and 88 for housing air relief valves 49 and air piping 55 and 56. A cap 95 of nonporous, water-impervious material is attached to and covers the wood core. Where seams are found at the corners, smaller cap members 96 are used to cover any potential crevices. Portions of the cap 95 are bent around risers 94 to form depending lips 97 which hide interior pockets 98 in the head 50 and foot 51. These pockets 98 open downwardly towards the water line to receive loose folds of the top membrane of the mattress 40 as seen in FIG. 8. The sides of these pockets 98 are closed by the sidewalls **58*a* of the base and frame assembly 52 as seen in FIG. 7. In this embodiment the head 50 and foot 51 have been formed in the same configuration to save manufacturing expense, but only one of these, preferably the head 50, need be used for evacuating air, and the foot 51** could be shorter in height.

Still referring to FIG. 8, the air relief valves 49 and air suction pipe 56 are connected into the mattress 40 by inserting a fitting through a hole cut in the top membrane of the mattress 40 for that purpose. A first locknut 99 is used to attach the membrane to the fitting, and a second locknut 100 is used to fasten the fitting to a portion of the cap 95 defining the top of the pocket 98 in foot 51. Pipe couplings 101 are then used to connect a pipe 102 between a fitting 103 secured to the mattress and a fitting 109 that receives that valve cap 53.

The cap 95 for the bed and frame assembly 52 is preferably made of stainless steel, to provide an exterior for the waterbed that can be easily cleaned and sterilized, when used in medical facilities. Acrylic polymeric materials can also be used for the the cap 95. The ends of the base and frame assembly 52 include vents 104 to allow heat from the pumps to escape. A layer of soundproofing material 105 is used to line the interior of the base and frame assembly 52 to muffle the sound of the pumps.

The water pump 43, the air pump 54, and a heater (not shown in FIGS. 7–9) are electrically powered through cables 106 extending from control unit 107. This control unit 107 includes pneumatically actuated electrical switches (not shown) which are controlled from a control panel 108 on top of head 50 of the base and frame assembly 52 as seen in FIG. 7. This control panel 108 is connected through pneumatic lines 110 in FIG. 8 to the switches in the control unit 107.

Although the description has included many details to enable those skilled in the art to carry out the best mode of the invention, it should be apparent to these persons that other embodiments could be constructed that utilize the principles of the invention and that these might differ in some respects from the preferred embodiments. Therefore, to fairly define the scope of which I regard as my invention, I have made the following claims.

I claim:

1. A waterbed for circulating streams of pressurized, heated water to massage a reclining person supported thereon, the waterbed comprising:

an enclosure having a top membrane of water-impervious material for supporting the reclining person in a floating manner on a volume of water that extends at least the length and width of the person;

a volume of water within said enclosure;

base means for supporting the enclosure in an elevated position;

a retainer of water-impervious material positioned between the base means and the enclosure;

an array of water inlets and at least one water outlet sealingly clamped to the retainer for support of the water inlets and water outlet in an elevated position by the base means, the water inlets opening into the interior of the enclosure and being aimed for directing streams of pressurized heated water upwardly towards the top membrane and the water outlet opening into the interior of the enclosure and being operable for conveying heated water out of the enclosure;

a water pump in fluid communication with the water outlet to draw the water from the enclosure and in fluid communication with the water inlets to provide recirculation, the water pump imparting sufficient pressure to the streams of pressurized heated water to drive the streams through the water in the enclosure to impinge on the top membrane.

2. The waterbed of claim 1, wherein the retainer is made of metal.

3. The waterbed of claim 1, wherein the pump is connected to the inlets and outlet through piping which hangs from the retainer and is also supported by the base means.

4. The waterbed of claim 1, further comprising:

air inlet means, coupled to the piping that conveys water to the water pump for recirculation, for allowing air to be drawn in to the water pump; and wherein the water pump is operable to generate a supply of water mixed with air to the water inlets so that jets of aspirated water are directed upwardly towards the underside of the top membrane.

5. The waterbed of claim 4, wherein:

a portion of the base means extends above and overhangs the top membrane; and further comprising air relief means anchored to the base means, coupled to a fold of the top membrane that extends above the water and opening into the interior of the enclosure to evacuate air therefrom.

6. The waterbed of claim 1, further comprising:

air inlet means opening into the interior of the enclosure and aimed for directing streams of pressurized air upwardly towards the underside of the top membrane; and further comprising an air pump disposed in the base means and connected to supply pressurized air to the air inlet means.

7. A waterbed for circulating streams of pressurized, heated water to massage a reclining person supported thereon, the waterbed comprising:

an enclosure having a top membrane of water-impervious material for supporting the reclining person in a floating manner on a volume of water that extends at least the length and width of the person;

base means for supporting the enclosure in an elevated position;

an air and water distributor disposed within the enclosure and having a water supply inlet and an air supply inlet extending through the base means to introduce water and air, respectively, into the enclosure, the air and water distributor also having a water supply outlet extending through the base means for withdrawing water from the enclosure, the air and water distributor also having a plurality of water stream ports aimed for directing streams of pressurized water upwardly towards the top membrane, the air and water distributor also having a plurality of air stream ports aimed for directing streams of pressurized air upwardly towards the top membrane, the air and water distributor also forming a water chamber communicating between the water supply inlet, the water supply outlet and the water stream ports, and the air and water distributor also forming an air chamber communicating between the air inlet and the air stream ports;

a water pump in fluid communication with the water supply outlet to draw the water from the enclosure and in fluid communication with the water supply inlet to provide recirculation, the water pump imparting sufficient pressure to the streams of pressurized water to drive the streams through the water in the enclosure to impinge on the top membrane; and an air pump disposed within the base means and connected to supply air to the air supply inlet.

8. A waterbed for circulating air and water to massage a person supported thereon, the waterbed comprising:

an enclosure having a top membrane of water-impervious material disposed over a volume of water, the top membrane having folds to permit air to be received and collected in the enclosure above the water and under a person supported on the top membrane;

base means extending along the bottom of the enclosure, the base means also having a head rising above and overhanging a head end of the enclosure, the head forming a downwardly opening pocket in which a fold of the top membrane is received, the pocket being hidden from view behind a depending portion of the head;

an air pump disposed within the base means and connected through an inlet to the interior of the enclosure to introduce pressurized air therein; and air relief means disposed in the head of the base means and extending into the pocket formed thereby, the air relief means being coupled to the enclosure and opening into the interior of the enclosure to evacuate air therefrom.

9. The waterbed of claim 8, further comprising means connecting the air relief means to the air pump to permit recirculation of air being evacuated from the enclosure.

10. The waterbed of claim 8, further comprising a cap of nonporous, water-impervious material that encases exposed exterior portions of the base means.

11. The waterbed of claim 8, wherein the cap is made of stainless steel.

* * * * *